US006808129B1

(12) United States Patent
Wang

(10) Patent No.: US 6,808,129 B1
(45) Date of Patent: Oct. 26, 2004

(54) SPRAYING DEVICE FOR LAWN SPRINKLER

(75) Inventor: King Yuan Wang, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 10/436,275

(22) Filed: May 13, 2003

(51) Int. Cl.[7] ..... B05B 3/08

(52) U.S. Cl. ..... 239/231; 239/240; 239/394; 239/222.19; 239/222.21; 239/390; 239/DIG. 1

(58) Field of Search ..... 239/231, 240, 239/232, 233, 246, 247, 248, 222.11, 222.19, 222.23, 223, 390–396, DIG. 1; D23/214

(56) References Cited

U.S. PATENT DOCUMENTS 4,501,391 A * 2/1985 Hunter ..... 239/97
5,680,990 A * 10/1997 Wang ..... 239/247
D488,533 S * 4/2004 Wang ..... D23/214

* cited by examiner

*Primary Examiner*—Dinh Q. Nguyen
(74) *Attorney, Agent, or Firm*—Troxell Law Office PLLC

(57) ABSTRACT

A spraying device for a lawn sprinkler is equipped with a circular base mount, a coupling board, a rotary sprinkling cover, a central flexible control piece and a water sprinkling blade assembly wherein the center of the circular base mount is disposed a water outlet having a securing hole in registration with the downward protrusion of the coupling board. The thermal meltable ring on the coupling board is used to make the coupling board secured to the rotary sprinkling cover by way of ultrasonic melting art. The inner space of the rotary sprinkling cover is divided into an inner and outer sections. At the center of the rotary sprinkling cover is disposed a cavity for housing of the retaining part, a spring, a support member and a seal ring and a water outlet screen cap of the central flexible control piece. The retaining hole of the screen cap is provided with a rotary shaft for the water sprinkling blade assembly so as to make the blade assembly to be horizontally positioned in the cavity whereby the water can be sprinkled evenly and smoothly from the sprinkling ports without interference or interruption by the blade assembly.

3 Claims, 8 Drawing Sheets

SPRAYING DEVICE FOR LAWN SPRINKLER

BACKGROUND OF THE INVENTION

The present invention relates to a spraying device for a lawn sprinkler. It is equipped with a circular base mount, a coupling board, a rotary sprinkling cover, a central flexible control piece and a water sprinkling blade assembly wherein the center of the circular base mount is disposed a water outlet having a securing hole in registration with the downward protrusion of the coupling board. The thermal meatball ring on the coupling board is used to make the coupling board secured to the rotary sprinkling cover by way of ultrasonic melting art The inner space of the rotary sprinkling cover is divided into an inner and outer sections. At the center of the rotary sprinkling cover is disposed a cavity for housing of the retaining part, a spring, a support member and a seal ring and a water outlet screen cap of the central flexible control piece. The retaining hole of the screen cap is provided with a rotary shaft for the water sprinkling blade assembly so as to make the blade assembly to be horizontally positioned in the cavity whereby the water can be sprinkled evenly and smoothly from the sprinkling ports without interference or interruption by the blade assembly.

Referring to FIG. 1, the first prior art lawn sprinkler 10 is made up of a base mount 11 and a spraying cap 12. A water inlet coupler 111 extends from one side of the base mount 11 and a circular platform 112 surrounded by a peripheral flange with a registration hole 113 defined at the center thereof and a water inlet 114 is disposed next to the registration hole 113. A retaining rib 115 having a retaining cut 1151. The spraying cap 12 is equipped with a plurality of spraying holes 121 in various patterns. A plurality of fixing legs 122 are disposed at the bottom of a central projection so as to register with the registration hole 113 of the base mount 11. The spraying holes 121 are provided with a stop wing 123 respectively distributed in radial directions. As the spraying cap 12 is rotated to one of the stop wings 123 and registered with the retaining cut 1151 of the retaining rib 115, one of the spraying holes 121 will become in alignment with the water inlet 114 so that water can be discharged from that spraying hole 121 as long as a water supply pipe is coupled with the water inlet coupler 11.

Such a prior art has a disadvantage given as follows: in particular, the center of the spraying cap 12 of the sprinkler 10 is not equipped with any spraying hole, so water can only be jetted or discharged by way of the peripherally disposed spraying holes 121. It is relatively simple and monotonous.

Referring to FIGS. 3, 4, the second prior art lawn sprinkler 20 comprises a round base mount 21, a coupling disc 22 and a rotary spraying cap 23 wherein the round base mount 21 has a central projected outlet 211 having a side coupler 212 in communication: with a water outlet 213 having a seal ring disposed therein. The central outlet 211 is provided with a fixing cavity 214 with which the retaining post 221 of the coupling disc 22 is registered. Next to the fixing cavity 214 is disposed a retaining post 215 based on a flexibly actuated plate. There are a plurality of round holes 222 defined around the periphery of the coupling disc 22. Each retaining recess 223 corresponding to the retaining post 215 is respectively disposed under the periphery of the round holes 222. A delicate protruded ring of melting connection 224 placed in alignment with the boundaries defined under the various spraying holes 231 is melted to created a closed wall to divide the internal space of the rotary spraying cap 23 into an inner and outer space. The center of the rotary spraying cap 23 has a centrally projected ball like pored sprayer 232. There are two closure discharge outlets 233 placed in opposition, the outer periphery are disposed spraying pores 234. The retaining post 221 is placed in the fixing cavity 214 with a proper clearance left therebetween so as to permit the coupling disc 22 to smoothly spin when the rotary spraying cap 23 is rotated in operation. As soon as the rotary spraying cap 23 is rotated to such a position that the surrounding walls of the ball like central pored sprayer 232 and one of the closure discharge outlets 233 comes into registration with the water outlet 213, water is then led to the inner space of the rotary spraying cap 23 and discharged via the central pored sprayer 232.

Such a second prior art lawn sprinkler 20 has the following disadvantage: the central pored sprayer 232 is integrally formed with the rotary spraying cap 23 and the top of the same is equipped with a ball shaped protrusion, resulting in the relatively bulky size in packing of the sprinkler in one aspect and the easy damage of the central pored sprayer 232 in transportation in another aspect.

Referring to FIGS. 5, 6, the third prior art lawn sprinkler 30 comprises a base mount 31, a rotary spraying cap 32 and a splattering blade assembly 33 wherein the base mount 31 has a flat top coupling face 311 with a central registration cavity 312. At one side of the flat top coupling face 311 is disposed a downwardly extended L-shaped inlet passage 313 having a connection head 3131 and on the other side is disposed a flexible spot protrusion 314. The rotary spraying cap 32 is provided with a protruded post 321 which is in registration with the registration cavity 312 of the base mount 31 so as to permit the rotary spraying cap 32 to be rotatable. On the top face of the rotary spraying cap 32 are disposed a plurality of spraying holes 322 of various patterns and a central pored spraying outlet 323 in communication with a closure spraying hole 324. The spraying holes 322 and the closure spraying hole 324 are in communication with the water outlet hole 325 which can be positioned in communication alignment with the inlet passage 313 when the rotary spraying cap 32 is rotated. There are a plurality of retaining cavities 326 corresponding to the water outlet hole 325 and registrable with the flexible spot protrusion 314. The shaft hole 331 of the blade assembly 33 is housed a bushing 332 having a pivot pole 333 which is engaged with the pivot hole 3231 of the central pored spraying outlet 323.

There are a number of disadvantages associated with the third prior art lawn sprinkler 30 given as follows:

1. The central pored spraying outlet 323 of the lawn sprinkler 30 is integrally formed with the rotary spraying cap 32 which has a ball shaped central surface. When the splattering blade assembly 33 is registered with the pivot hole 3231 defined on the spraying outlet 323, it will render the size of packing and delivery increased and the superficial face of the pored spraying outlet 323 is easily damaged as a result of impact
2. The splattering blade assembly 33 is mounted on top of the rotary spraying cap 32, as water is sprayed out of the spraying hole 322 via the sloped peripheral surface 3221, the sprayed water will be interfered by the blade assembly 33 in the area A as shown in FIG. 6, spoiling the spraying path of water.
3. The blade assembly 33 in rotation will be easily got stuck with the pivot pole 333 due to rotary friction, causing the rotary operation without smoothness.

SUMMARY OF THE INVENTION

Therefore, the primary object of the present invention is to provide a spraying device for a lawn sprinkler wherein the blade assembly can be retractably housed in a fixing cavity so as to allow the blade assembly to be received in flush with the top surface of the rotary spraying cap to reduce the packing size and to protect the blade assembly from damage as a result of impact.

Another object of the present invention is to provide a spraying device for a lawn sprinkler wherein the blade assembly can be selectively concealed in or popped out of a fixing cavity by means of a central flexible control piece so as to prevent the sprayed water from being interfered by the blade assembly in operation.

One further object of the present invention is to provide a spraying device for a lawn sprinkler wherein the splattering blade assembly is engaged with a pivot pole by way of a lubricant pad member so as to prevent the blade assembly from being in frictional contact with the pivot pole, rendering the rotary movement of the blade assembly smooth.

DETAILED DESCRIPTION OF THE PREFERRED EMBODIMENTS

Figure 1:
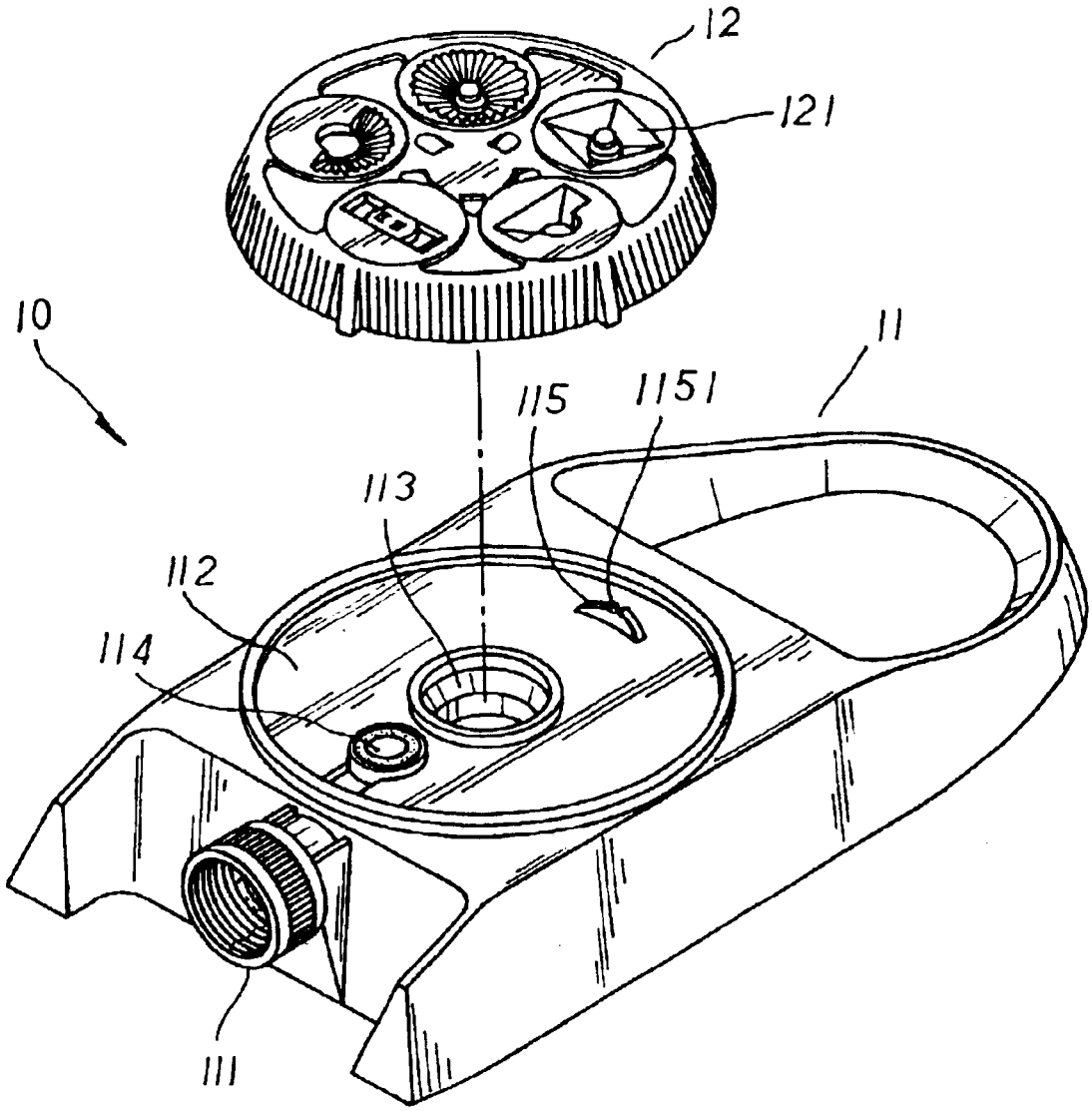
PRIOR ART FIG. 1
FIG. 1 is a perspective diagram showing the exploded components of a first prior art.
Figure 2:
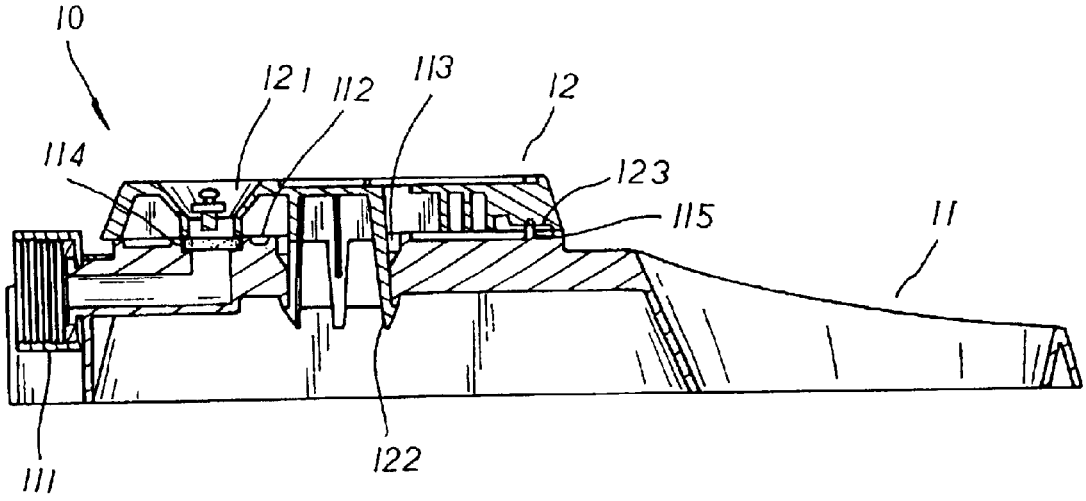
FIG. 2 PRIOR ART
FIG. 2 is a sectional diagram of the assembly of the first prior art shown in FIG. 1.
Figure 4:
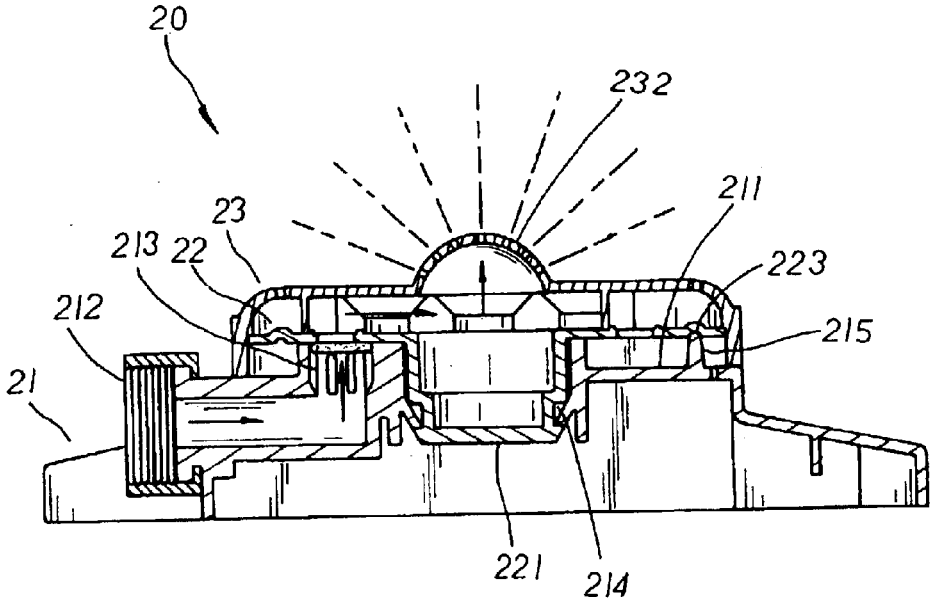
FIG. 4 PRIOR ART
FIG. 4 is a sectional diagram showing the operation mode of the second prior art.
Figure 3:
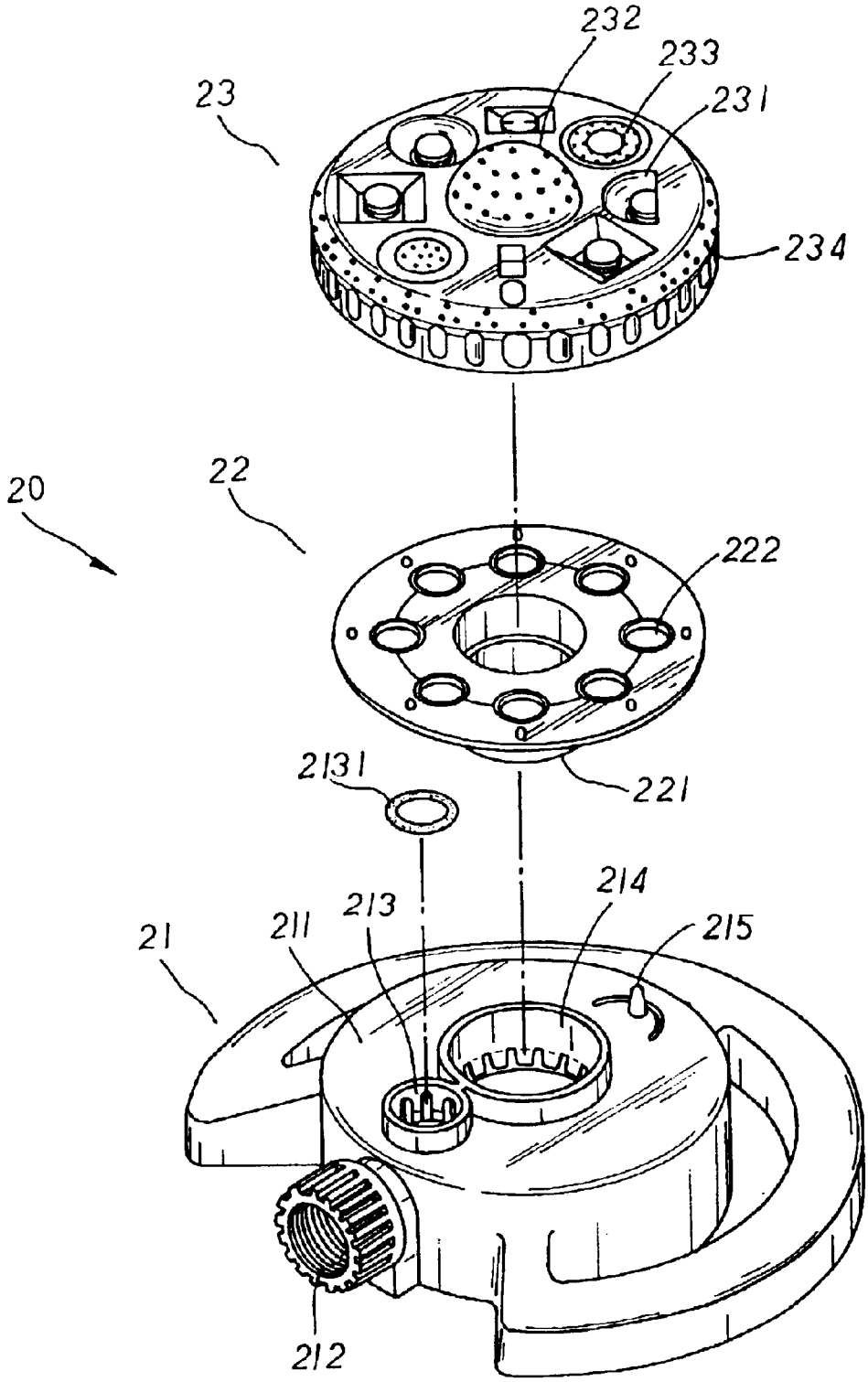
PRIOR ART FIG. 3
FIG. 3 is a perspective diagram showing the exploded components of a second prior art.
Figure 5:
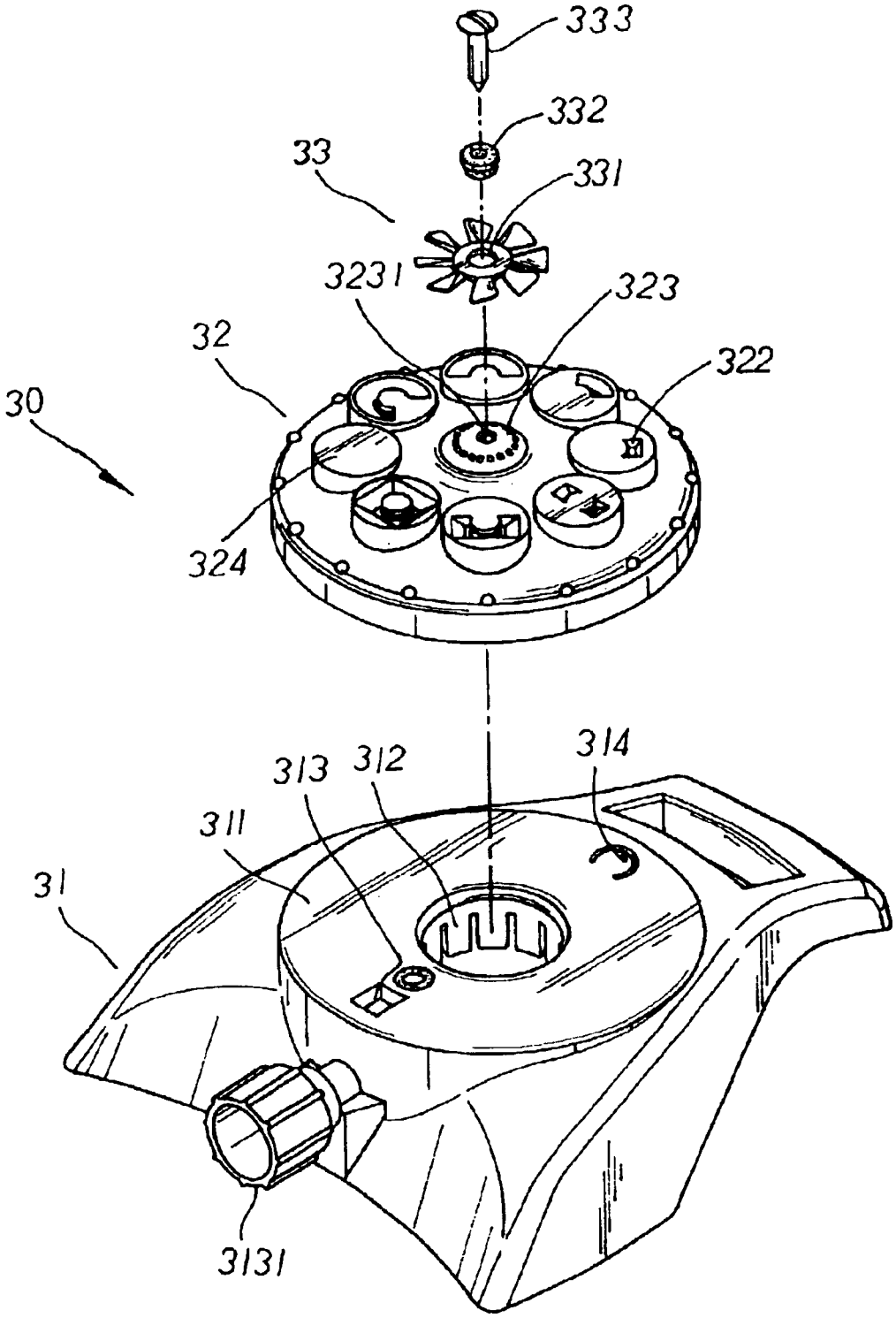
PRIOR ART FIG. 5
FIG. 5 is a perspective diagram showing the exploded components of a third prior art.
Figure 6:
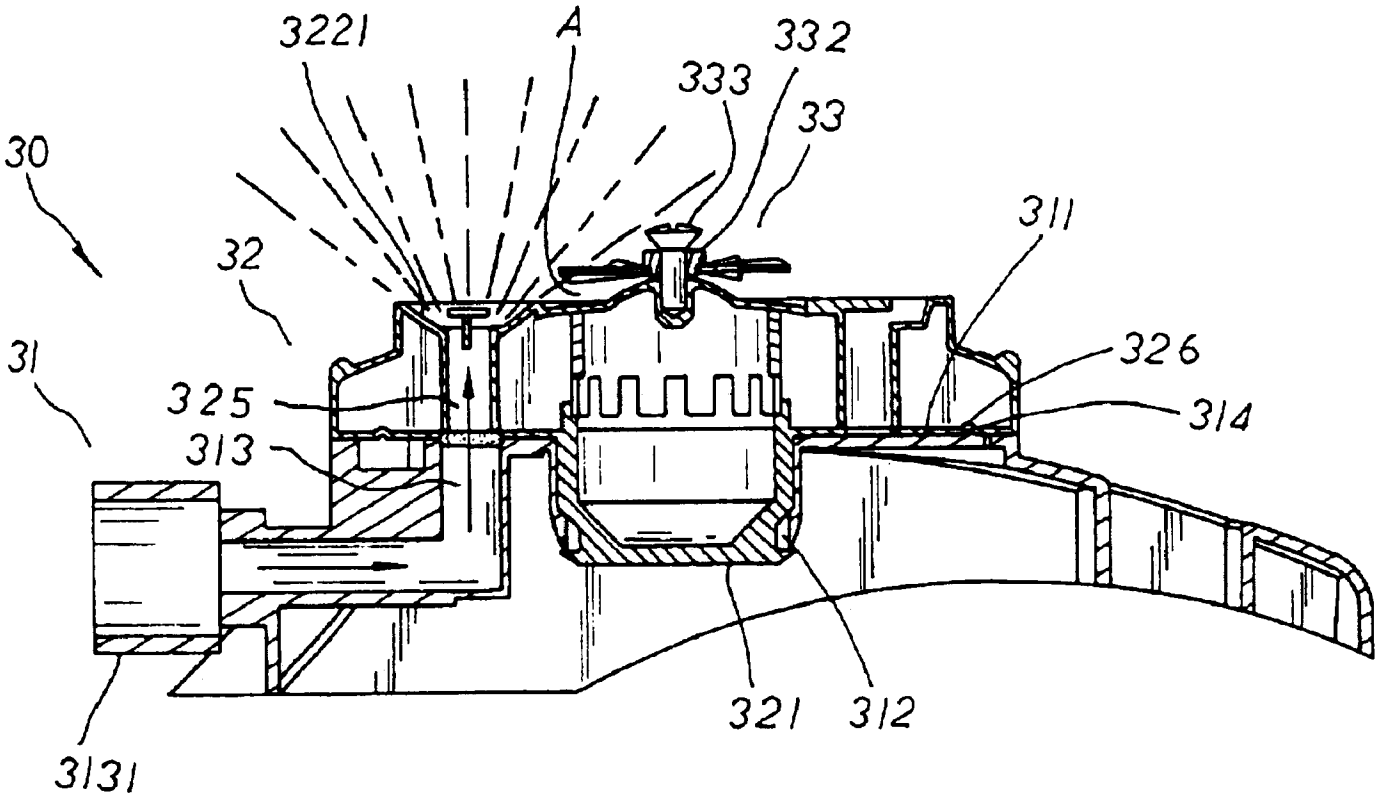
PRIOR ART FIG. 6
FIG. 6 is a sectional diagram of the operation mode of the third prior art.
Figure 7:
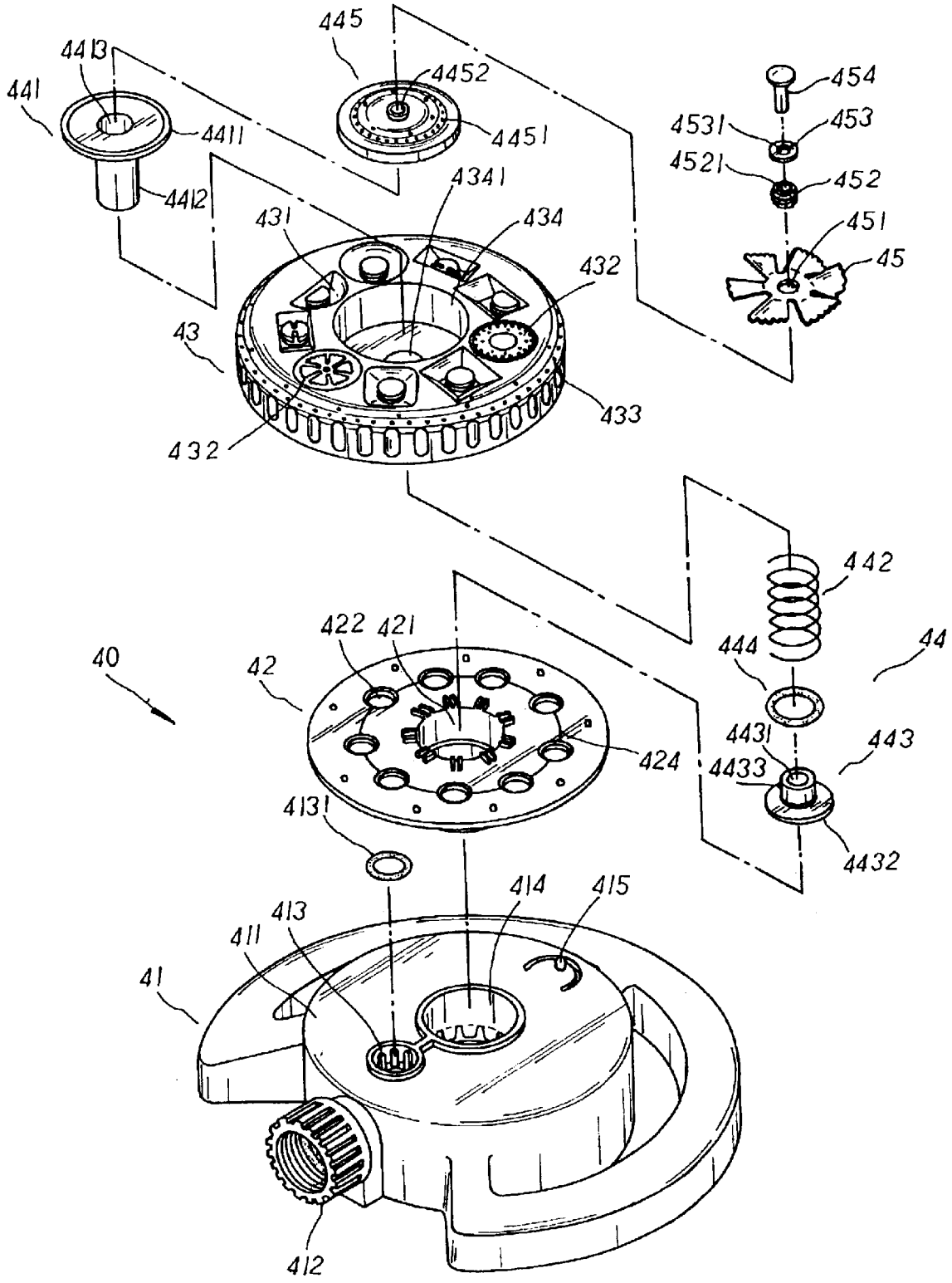
FIG. 7 is a perspective diagram showing the exploded components of the present invention.
Figure 8:
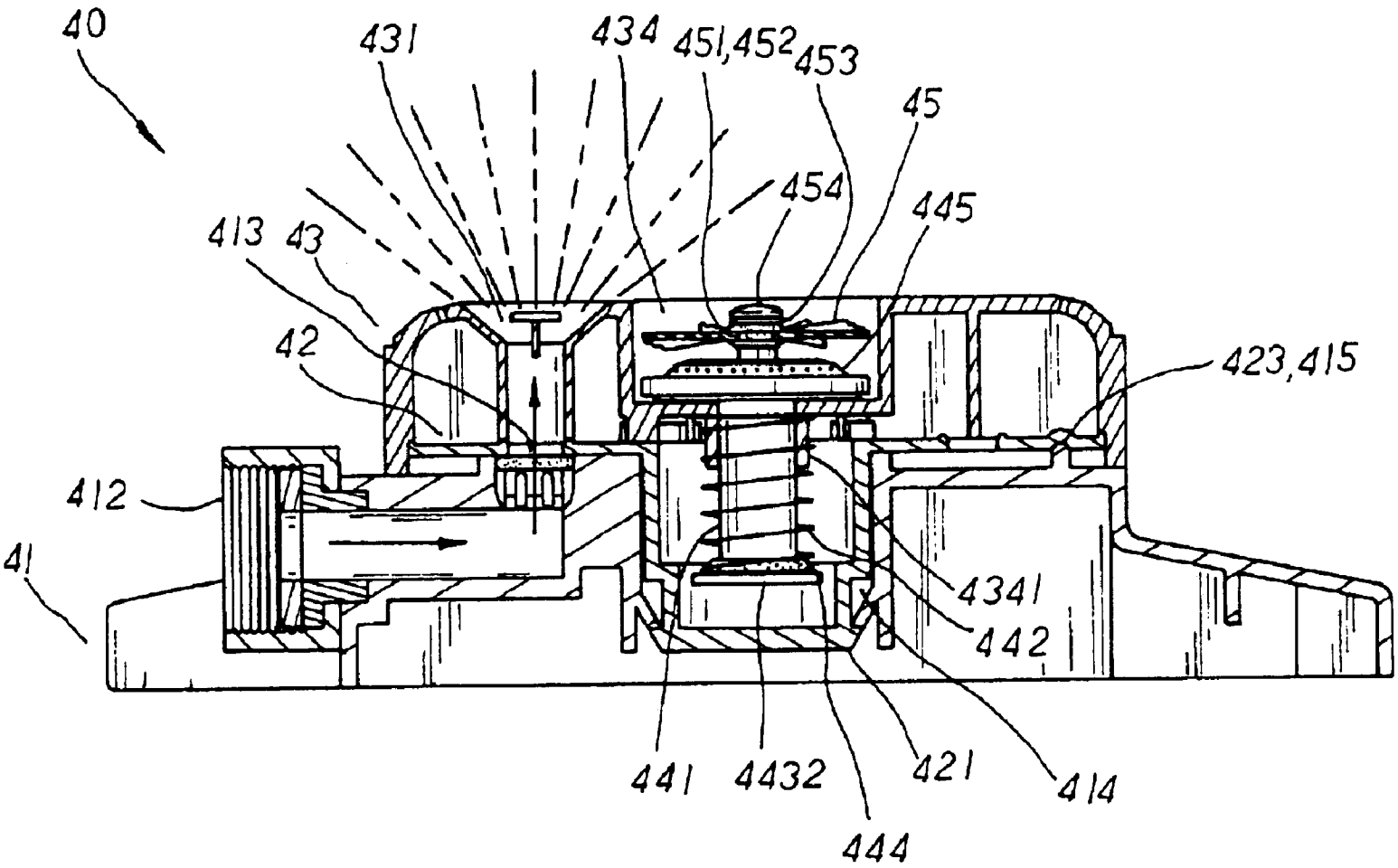
FIG. 8 is a diagram showing the operation mode of the multiple-patterned spraying hole of the present invention.

Referring to FIG. 7, the perspective diagram of the present invention illustrates the exploded components of the present invention with reference to FIG. 8. The spraying device 40 is made up of a circular base 41, a coupling disc 42, a rotary sprinkling cover 43, a central flexible control piece 44 and a water splattering blade assembly 45. The circular base 41 is equipped with a water outlet seat 411 protruded at the center thereof and a connector 412 projecting from the side thereof communicates with an outlet 413 having a seal ring 4131 disposed inside. At the center of the water outlet seat 411 is disposed a fixing cavity 414 and at the other side of which is disposed a retaining pole 415 planted on a flexible plate. At the center of the coupling disc 42 is disposed a downwardly extended hollow retaining post 421 with a plurality of round holes 422 defined on the periphery thereof. A registration recess 423 in correspondence to the retaining pole 415 is disposed on the underside of each round hole 422. A thin melting ring line 424 coupling the round holes 422 one by one. The rotary sprinkling cover 43 is provided with a plurality of sprinkling openings 431 of various patterns disposed along the periphery of the top surface and two of the sprinkling openings 431 are made in a closure 432 and on the peripheral edge of the rotary sprinkling cover 43 are disposed a plurality of spraying pores 433. At the center of the rotary sprinkling cover 43 is disposed a concealing cavity 434 having a downward tubular extension 4341.

The central flexible control piece 44 is made up of a positioning member 441, a spring 442, a support member 443, a seal ring 444 and a water discharge cap 445. The positioning member 441 has a round stop disc 4411 and a downwardly extended pole 4412 having a central through hole 4413 defined thereon. The support member 443 has retaining cylinder 4433 having a through hole 4431 defined at the center and a round limiting disc 4432 at the base. The discharge cap 445 has a plurality of pores 4451 on the periphery with a central fixing hole 4452. The blade assembly 45 has a central shaft hole 451 with a retaining rubber 452 having a central hole 4521 defined thereon. Above the retaining rubber 452 is placed a lubricating pad 453 having a central through hole 4531. A fixing pin 454 is led through the central through hole 4531 of the lubricating pad 453 and the central hole 4521 of the retaining rubber 452 in sequence.

In assembly, the discharge cap 445 is engaged with the round stop disc 4411 of the positioning member 441 to define a closed water outlet space therebetween, then the extended pole 4412 of the positioning member 441 is led through the tubular extension 4341 of the concealing cavity 434 with the round stop disc 4411 housed in the concealing cavity 434. Next, the spring 442 is engaged with the extended pole 4412 and is in abutment with the bottom face of the concealing cavity 434. The seal ring 444 is attached to the end of the extended pole 4412 and at the same time the retaining cylinder 4433 of the support member 443 is registered with the central through hole 4413 of the positioning member 441 with the end of the spring 442 in abutment against the round limiting disc 4432. The positioning member 441 is pulled downwardly with the round stop disc 4411 in abutment against the bottom surface of the concealing cavity 434 to complete the assembly of the central control piece 44.

Next, the melting ring line 424 of the coupling disc 42 is placed in line with the rotary sprinkling cover 43 and the two components are fixed together by ultrasonic welding art so as to define an internal and an external space. Afterwards, the hollow retaining post 421 is inserted into the fixing cavity 414 of the circular base 41 with a clearance left between the fixing cavity 414 and the retaining post 421 so as to the rotary sprinkling cover 43 can be properly rotated. Then the fixing pin of the assembled blade assembly 45 is registered with the central fixing hole 4452 of the discharge cap 445 so as to make the blade assembly 45 received in the concealing cavity 434 due to the action of the spring 442 on the positioning member 442 and line flush with the upper edge of the rotary sprinkling cover 43. In such a manner the delivery and storage of the lawn sprinkler becomes easy and safe in one aspect and the packing size can be reduced in another aspect.

In operation, as the blade assembly 45 is completely received in the concealing cavity 434 by way of the design of the central control piece 44, water discharged or sprayed out of the sprinkling openings 431 will not be interfered by the blades of the blade assembly 45. Thus water can be discharged smoothly without interruption in one aspect and the blade assembly 45 can be protected from abrasion and damage for better and longer operation.

Figure 9:
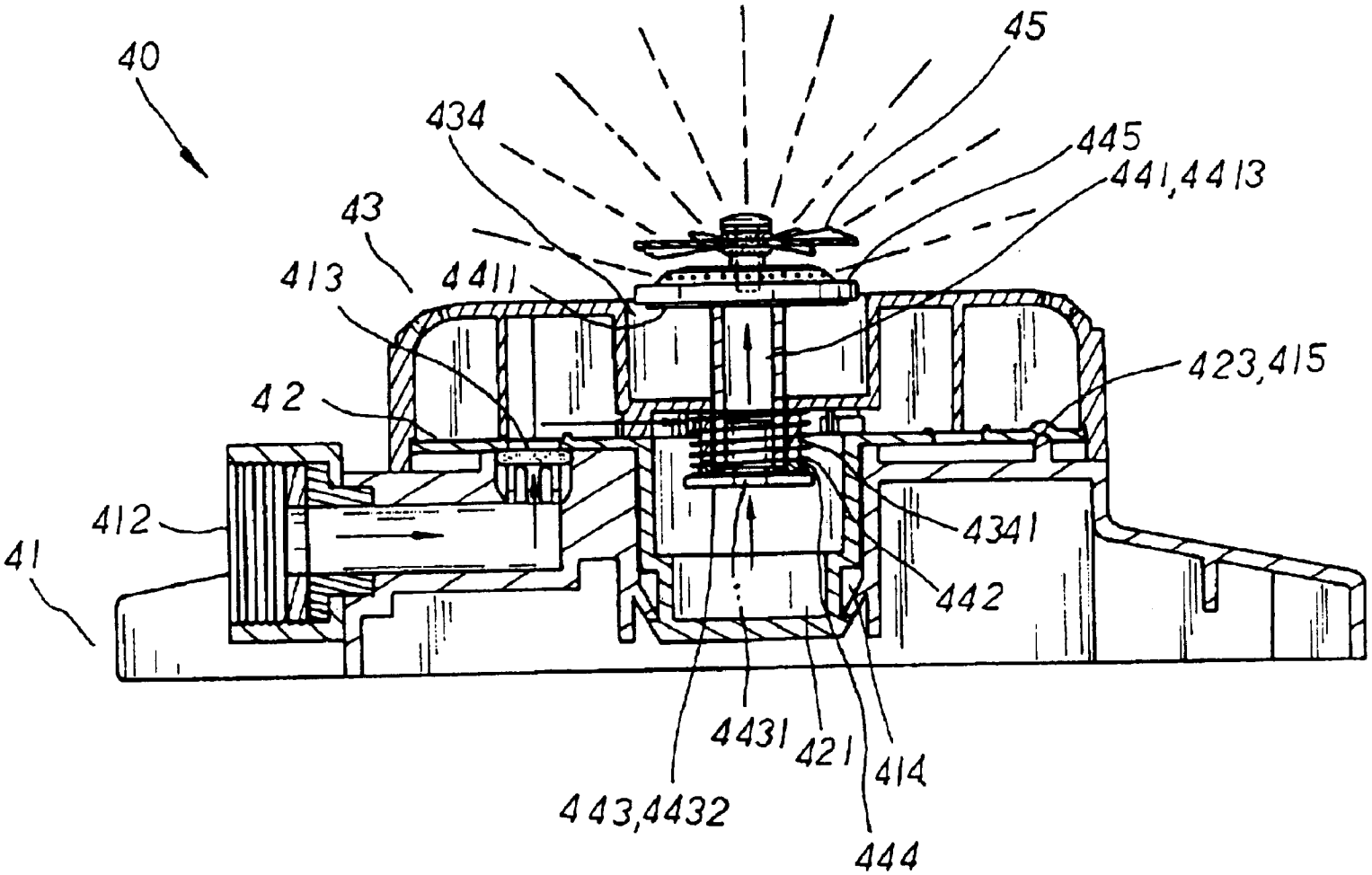
FIG. 9 is a diagram showing the spraying mode at the center of the present invention.

Moreover as shown in FIG. 9, when the closure 432 of the rotary sprinkling cover 43 comes into registration with the outlet 413, water is confined in the internal space of the rotary sprinkling cover 43 and is collected in the hollow retaining post 421 of the coupling disc 42; as a result, the water will push the round limiting disc 4432 of the support member 443 to move upwardly to compress the spring 442 with the limiting disc 4432 in abutment against the bottom of the tubular extension 4341. Thereby, the blade assembly 45 will pop out of the concealing cavity 434 by way of the central control piece 44. At the same time, the water is sequentially led into the through hole 4431 of the support member 443 and the central through hole 4413 of the positioning member 441 and then is discharged out of the a plurality of pores 4451 of the discharge cap 445. The blades of the blade assembly 45 will be forced to spin so that water will be spattered in a larger area. Besides, the blade assembly 45 and the fixing pin 454 are separated by the lubricating pad 453 so that the blade assembly 45 operated without in friction against the fixing pin 454 will rotate in a smoother manner.

I claim:

1. A spraying device for a lawn sprinkler, comprising:

a circular base, a coupling disc, a rotary sprinkling cover, a central flexible control piece and a water splattering blade assembly;

wherein said circular base has a water outlet seat protruded at the center thereof with a fixing cavity for registration with a hollow retaining post of said coupling disc; a protruded melting ring line on said coupling disc permits said coupling disc to be fixed to said rotary sprinkling cover by ultrasonic welding art so as to divide a space inside said rotary sprinkling cover into an internal and external space;

at the center of said rotary sprinkling cover is disposed a concealing cavity having a downward tubular extension;

said central flexible control piece has a positioning member, a spring, a support member, a seal ring and a water discharge cap; said positioning member has a round stop disc and a downwardly extended pole having a central through hole defined thereon; said support member has retaining cylinder having a through hole defined at a center and a round limiting disc at a base; said discharge cap has a plurality of pores on the periphery with a central fixing hole for engagement with a shaft pin of said blade assembly; whereby said blade assembly can be concealed in said concealing cavity of said rotary sprinkling cover when not in operation and is pushed by a controlled water flow out of said concealing cavity.

2. The spraying device for a lawn sprinkler as claimed in claim 1 wherein said blade assembly is equipped with a lubricating pad on said shaft pin right above a retaining rubber.

3. The spraying device for a lawn sprinkler as claimed in claim 1 wherein said blade assembly is received in said concealing cavity of said rotary sprinkling cover flush with a periphery of said concealing cavity.

* * * * *